US006667432B2

(12) United States Patent
Brando

(10) Patent No.: US 6,667,432 B2
(45) Date of Patent: Dec. 23, 2003

(54) DRUMHEAD TENSIONING DEVICE AND METHOD

(75) Inventor: Marlon Brando, Beverly Hills, CA (US)

(73) Assignee: Penny Poke Farms, Ltd., Beverly Hills, CA (US)

( * ) Notice: Subject to any disclaimer, the term of this patent is extended or adjusted under 35 U.S.C. 154(b) by 0 days.

(21) Appl. No.: 10/133,241

(22) Filed: Apr. 26, 2002

(65) Prior Publication Data

US 2002/0184991 A1 Dec. 12, 2002

Related U.S. Application Data

(63) Continuation-in-part of application No. 10/015,489, filed on Dec. 12, 2001, now Pat. No. 6,441,286, which is a continuation-in-part of application No. 09/878,516, filed on Jun. 8, 2001, now Pat. No. 6,410,833.

(51) Int. Cl.[7] ..... G10D 13/02
(52) U.S. Cl. ..... 84/411 R; 84/421
(58) Field of Search ..... 84/411, 413, 419, 84/420, 421

(56) References Cited

U.S. PATENT DOCUMENTS

| | | | | |
|---|---|---|---|---|
| 769,527 A | | 9/1904 | Bahr | |
| 1,916,123 A | | 6/1933 | Greenleaf | |
| 3,376,777 A | | 4/1968 | Becker-Ehmck | 84/419 |
| 3,701,834 A | | 10/1972 | Rubio | 84/419 |
| 3,747,463 A | | 7/1973 | Hinger | 84/419 |
| 4,112,807 A | | 9/1978 | Quibell | 84/411 R |
| 4,122,748 A | | 10/1978 | May | 84/411 A |
| 4,122,749 A | | 10/1978 | Hoellerich | 84/419 |
| 4,244,265 A | | 1/1981 | Tuttrup | 84/411 R |
| 4,278,003 A | | 7/1981 | Hanson | 84/411 |
| 4,635,524 A | | 1/1987 | Allen et al. | 84/419 |
| 4,694,726 A | | 9/1987 | Silvestri | 84/413 |
| 4,709,613 A | | 12/1987 | Powers et al. | 84/413 |
| 4,831,912 A | | 5/1989 | Allen | 84/419 |
| 4,909,125 A | | 3/1990 | Fece | 84/411 A |
| 5,392,681 A | | 2/1995 | Hall | 84/413 |
| 6,043,421 A | | 3/2000 | Adams | 84/419 |
| 6,410,833 B1 | * | 6/2002 | Brando | 84/411 R |
| 6,441,286 B1 | * | 8/2002 | Brando et al. | 84/411 R |

FOREIGN PATENT DOCUMENTS

| | | |
|---|---|---|
| GB | 592979 | 10/1947 |

* cited by examiner

*Primary Examiner*—Kimberly Lockett
(74) *Attorney, Agent, or Firm*—Seed IP Law Group PLLC

(57) ABSTRACT

In a tunable drum, a connector member in the drum is attached by linkages to a tuning ring, and is threadedly coupled by a tuning linkage to a retaining member fixed to the drum. Rotation of the tuning linkage with respect to the drum moves the connector member longitudinally and, as a result, adjusts the tension of the drumhead. In one embodiment, a handle is oriented at an angle to the tuning linkage, and is coupled to the tuning linkage such that an operator can adjust the tuning linkage from the side of the drum.

25 Claims, 10 Drawing Sheets

DRUMHEAD TENSIONING DEVICE AND METHOD

CROSS-REFERENCE TO RELATED APPLICATIONS

This application is a continuation-in-part of 10/015,489, filed Dec. 12, 2001, now U.S. Pat. No. 6,441,286 which is a continuation-in-part of Application Ser. No. 09/878,516, filed Jun. 8, 2001 now U.S. Pat. No. 6,410,833.

TECHNICAL FIELD

The present invention is directed toward percussion drums and, in particular, to apparatus, systems and methods for adjusting the tension of a drumhead.

BACKGROUND OF THE INVENTION

Percussion drums have been used for hundreds, if not thousands, of years to produce sounds either alone or in combination with other musical instruments. A typical drum has a hollow body or shell over which a drumhead is stretched. A typical drumhead is circular and terminates at its outer boundary at a rigid or substantially rigid rim. When the drumhead is placed over the mouth of the shell, the rim is positioned slightly outside of the shell. A tensioning ring is positioned over the rim and is attached to the shell to retain the drumhead in tension across the mouth.

The tensioning ring is commonly attached to the shell by a number of threaded rods that extend between the tensioning ring and brackets on the outer surface of the shell. Threaded nuts are tightened on the threaded rods to move the tensioning ring toward the brackets, thus tightening the drumhead. A typical drum has six or more of such threaded rods. Accordingly, adjusting the tension in the drumhead typically requires the tightening of six or more separate nuts.

A number of tuning mechanisms have been developed in the past to make tuning the drumhead easier. Most of these mechanisms are incorporated into kettle drums, such as that illustrated in U.S. Pat. No. 4,831,912 to Allen et al. Other mechanisms, such as those illustrated in U.S. Pat. No. 4,244,265 to Tuttrup and U.S. Pat. No. 4,909,125 to Fece, have been developed for other types of drums.

None of the devices known to the inventor provide a simple and affordable drumhead tuner that is at the same time accurate and reliable. The mechanisms illustrated in Allen et al. and Fece, for example, are elaborate and likely expensive to manufacture. Accordingly, although they may be appropriate for expensive drums of the type illustrated therein, they may be inappropriate for simpler and/or less expensive types of drums.

Further, the mechanisms illustrated in Fece and Tuttrup are both subject to inadvertent adjustments that may accidentally modify the tone of the drum. The Fece device may be accidentally rotated, which would result in the drumhead tension changing. Similarly, the cables extending along the outside of the shell of the Tuttrup device could be displaced by the drummer or a drum stand, or the jackscrew inadvertently impinged, to accidentally change the tone of the drum.

It is therefore apparent that a need exists for a simple and inexpensive drum tuning device that is also accurate and reliable and not subject to inadvertent adjustments.

SUMMARY OF THE INVENTION

The present invention is directed toward a tunable drum for use with or without a drum stand having a first coupling fixed thereto that rotates as a unit with the drum stand. Embodiments of the invention allow an individual to quickly and reliably tune the drum either manually or by rotating the drum in the drum stand.

In one particular embodiment, the drum incorporates a shell, a drumhead, a tuning ring and an adjustment assembly. The shell has opposing first and second ends with a first mouth at the first end and a second mouth at the second end. The drumhead covers the first mouth, and is retained against the shell by the tuning ring. The tuning ring is held against the drumhead by a number of cords, cables or other elongated linkages. The cables extend from the tuning ring to the adjustment assembly through holes in the shell.

The adjustment assembly is made up of a connector member, a retaining member, a tuning linkage and a second coupling. The connector member is positioned inside the shell, and the cables are coupled to the connector member. The retaining member is positioned within the shell on the side of the connector member toward the second end of the shell, and is coupled to the shell to remain longitudinally fixed within the shell. The tuning linkage is threadedly coupled between the retaining member and the connector member such that rotation of the tuning linkage moves the connector member longitudinally within the shell and, as a result, adjusts the tension of the drumhead.

In another embodiment, a handle is fixed to the tuning linkage, and is positioned to engage a complementary coupling in the drum stand when the drum is retained by the drum stand.

In still another embodiment, the complementary coupling on the drum stand is movable between operative and inoperative positions. In the operative position, the coupling in the drum stand engages the handle, and the drum can be tuned by rotating it with respect to the drum stand. In the inoperative position, the drum can be placed in the drum stand without the handle engaging the complementary coupling.

In still another embodiment, the linkages extending between the tuning ring and the connector member are substantially rigid and are mounted to the shell to pivot about a point between the ends of the linkage. One end of the linkage extends internally to the drum and an opposing end of the linkage projects outwardly from the shell. The internal end of the linkage is coupled to the connector member to move with a tuning assembly toward and away from the drumhead. The external portion of the linkage moves in an opposite direction as the internal portion. The external portion of the linkage is coupled to the tuning ring. Thus, longitudinal movement of the tuning assembly and the internal portion of the linkage results in opposing longitudinal movement of the external portion of the linkage and, as a result, tuning of the drumhead. The relative lengths of the internal and external portions of the linkage can be varied to adjust the torques and ranges of motion of the respective ends.

DETAILED DESCRIPTION OF THE ILLUSTRATED EMBODIMENTS

The present detailed description is generally directed toward systems, apparatus and methods for reliably and accurately tuning a drumhead, and for preventing accidental adjustments to the drumhead's tension. Several embodiments of the invention allow an individual to tune the drumhead manually or by rotating the drum within the drum stand of the invention. The inventive drum stand, however, can be configured to prevent accidental changes to the tension of the drumhead.

Many specific details of certain embodiments of the invention are set forth in the following description and in FIGS. 1–11 to provide a thorough understanding of such embodiments. One skilled in the art, however, will understand that the present invention may have additional embodiments, or may be practiced without several of the details described in the following description.

Figure 1:
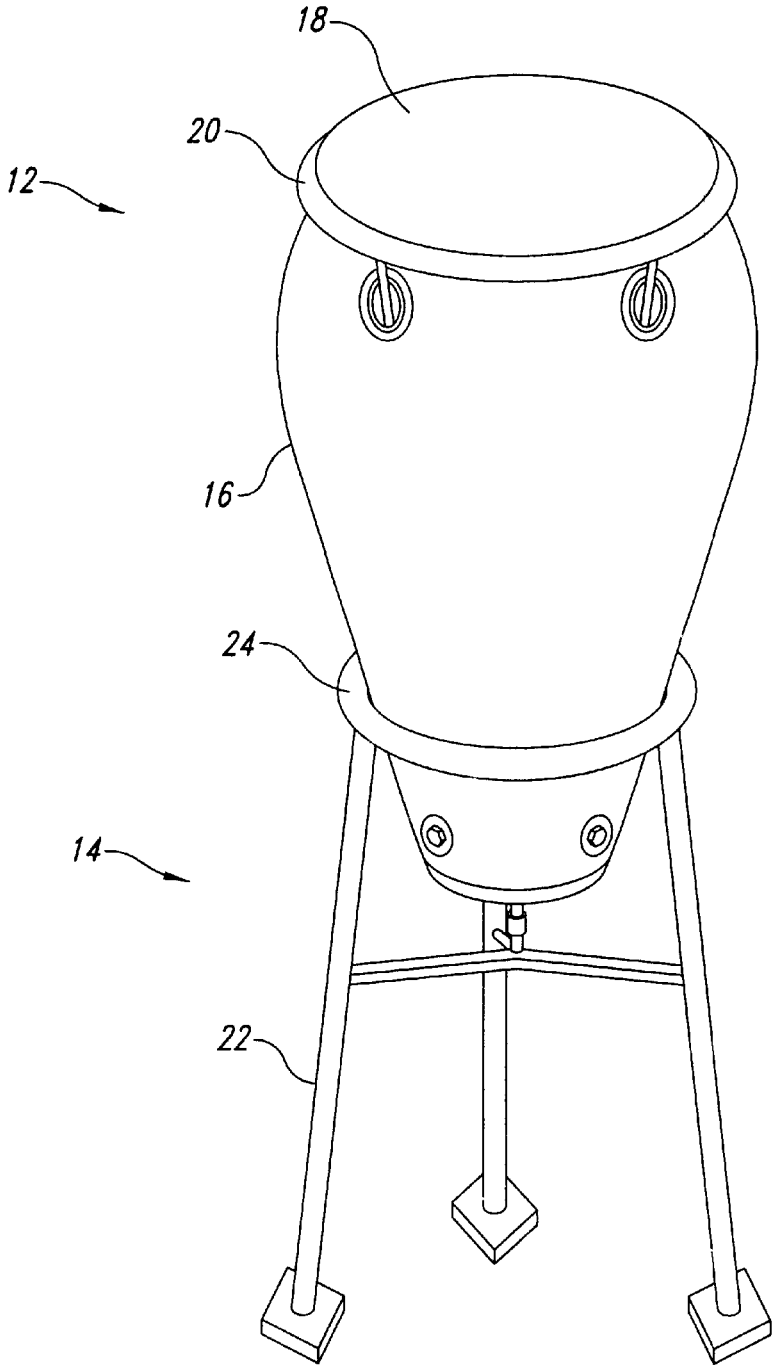
FIG. 1 is an isometric view of a drum and a drum stand according to one particular embodiment of the present invention.

FIG. 1 generally illustrates a drum 12 and drum stand 14 according to one embodiment of the present invention. The drum 12 generally has a shell 16, a drumhead 18 and a tuning ring 20. The shell 16 in the illustrated embodiment is in the form of a conga drum. The inventor appreciates, and one of ordinary skill in the art will understand, that the present invention can apply to a wide variety of drum types. For simplicity purposes, however, the following disclosure is directed toward the illustrated conga drum version of the present invention.

The illustrated drum stand 14 has three legs 22 supporting an upper ring 24 that encircles and retains the drum shell 16 when the drum 12 is in the drum stand. The upper ring 24 can be padded to protect the surface of the shell 16, and can be coated with a surface treatment to prevent the shell from rotating with respect to the drum stand when the shell is fully seated therein.

Figure 2:
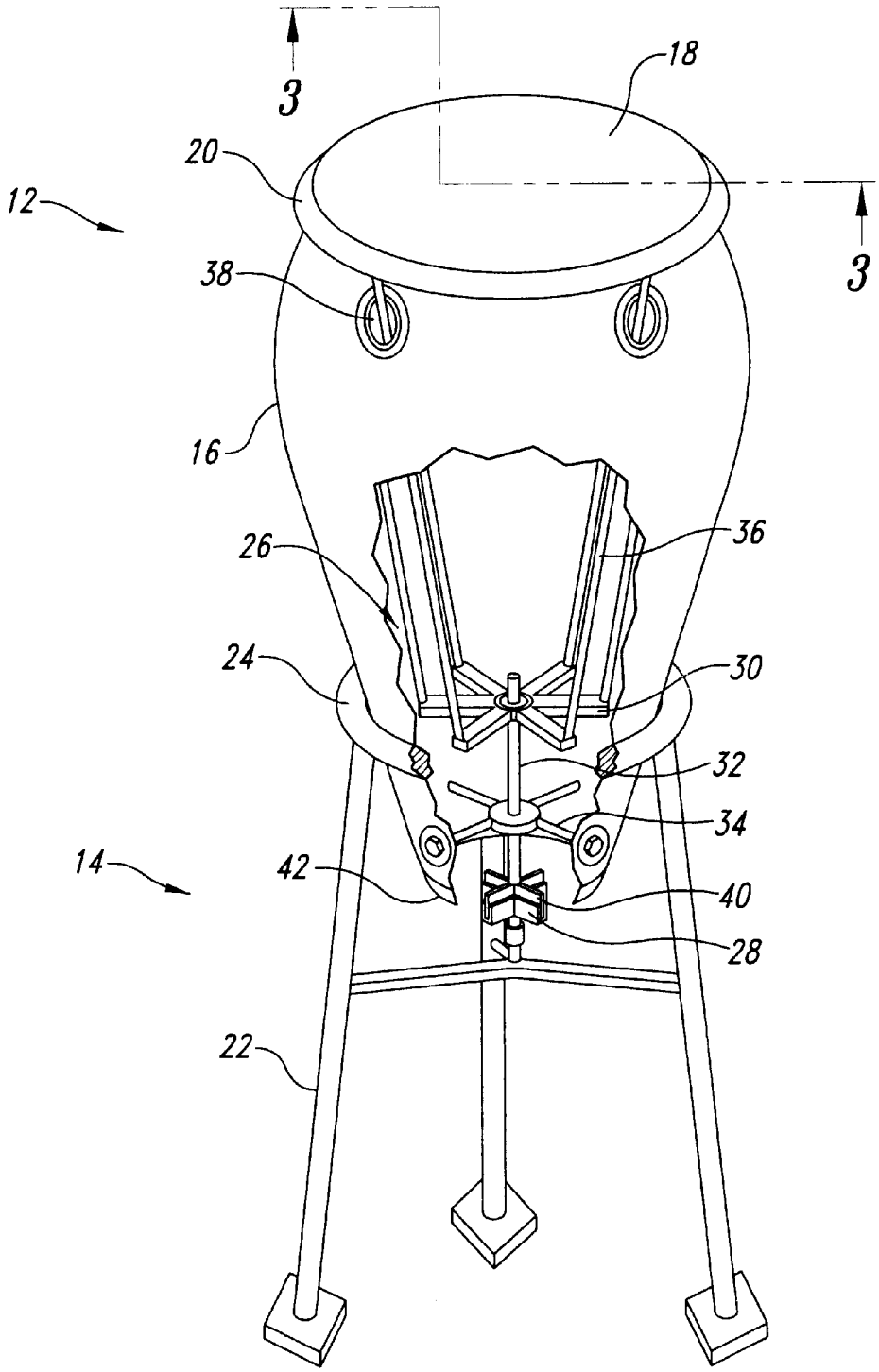
FIG. 2 is an isometric cutaway view of the drum and the drum stand of FIG. 1, illustrating a tuning assembly according to this particular embodiment of the present invention.

FIG. 2 best illustrates a tuning assembly 26 within the drum 12 engaged with an actuator 28 on the drum stand 14. The tuning assembly 26 incorporates a spider member 30, a threaded rod 32, and a retaining member 34. The spider member 30 is connected to the tuning ring 20 by a number of cables 36. Each cable 36 is coupled to the tuning ring 20 at a location outside the shell 16, extends through a hole 38 in the shell, and is coupled to the spider member 30 at a location inside the shell 16. As discussed in more detail below, the threaded rod 32 passes through the retaining member 34 before terminating at a key 40 at its lower end. In the illustrated embodiment, the key 40 is positioned above a bottom rim 42 of the shell 16 so the drum 12 can be set on a flat surface without the key impinging upon the flat surface. The retaining member 34 is fixed to the shell 16, as discussed in more detail below.

Figure 3:
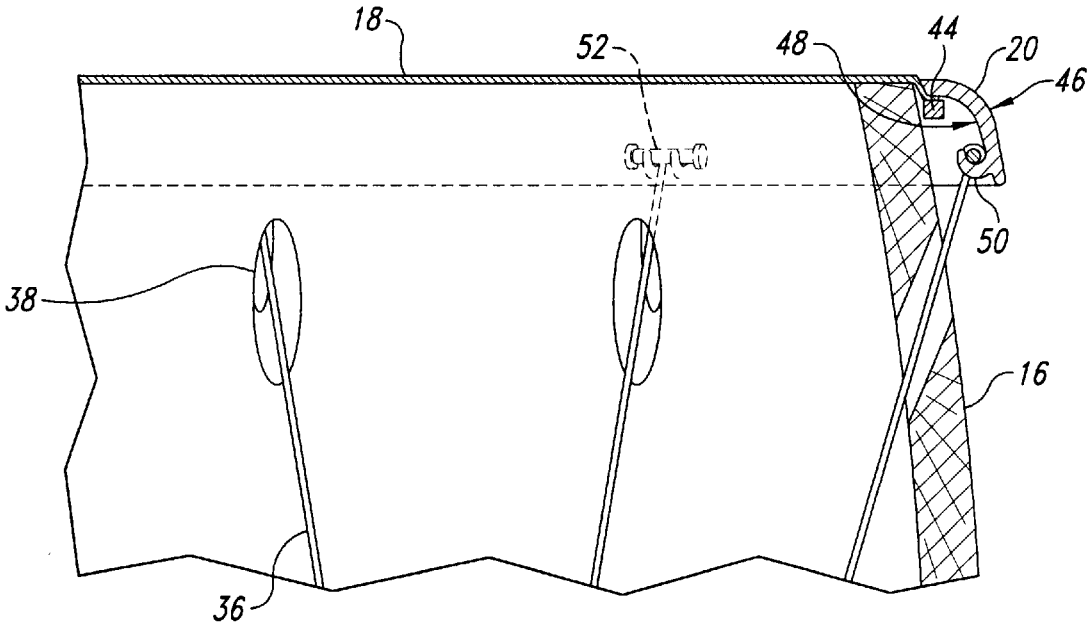
FIG. 3 is a sectional elevation view of an upper portion of the drum of FIG. 2, seen along Section 3—3.

FIG. 3 illustrates the relationship between the drumhead 18, the tuning ring 20 and the cables 36 in this particular embodiment. The drumhead 18 is generally circular, and terminates at its outer edge at an enlarged rim or bead 44. The bead 44 is positioned slightly outside the shell 16 when the drumhead 18 is properly fitted on the shell. The tuning ring 20 is complementary in shape to the shell 16 to fit over the shell and contact the enlarged bead 44 along its entire perimeter. Thus, urging the tuning ring 20 downward results in an increased tension in the drumhead 18. An upper surface 46 of the tuning ring 20 is curved downward, and is smooth to allow an individual to comfortably play the drum. A lower surface 48 of the tuning ring 20 has a number of hairs of prongs 50 spaced about the perimeter of the tuning ring to align with the holes 38. Each prong 50 projects inward from the lower surface 48 and upward when configured for use. The pair of prongs 50 thus creates a fastener to which an elongated rod 52 at the upper end of the cable 36 can be retained. The cable 36 can be wrapped around the elongated rod 52, or can be attached by any other means generally understood in the art. As discussed above, the cables 36 extend downward from the tuning ring 20, through the openings 38 in the shell 16 to the tuning assembly (not shown).

Figure 4:
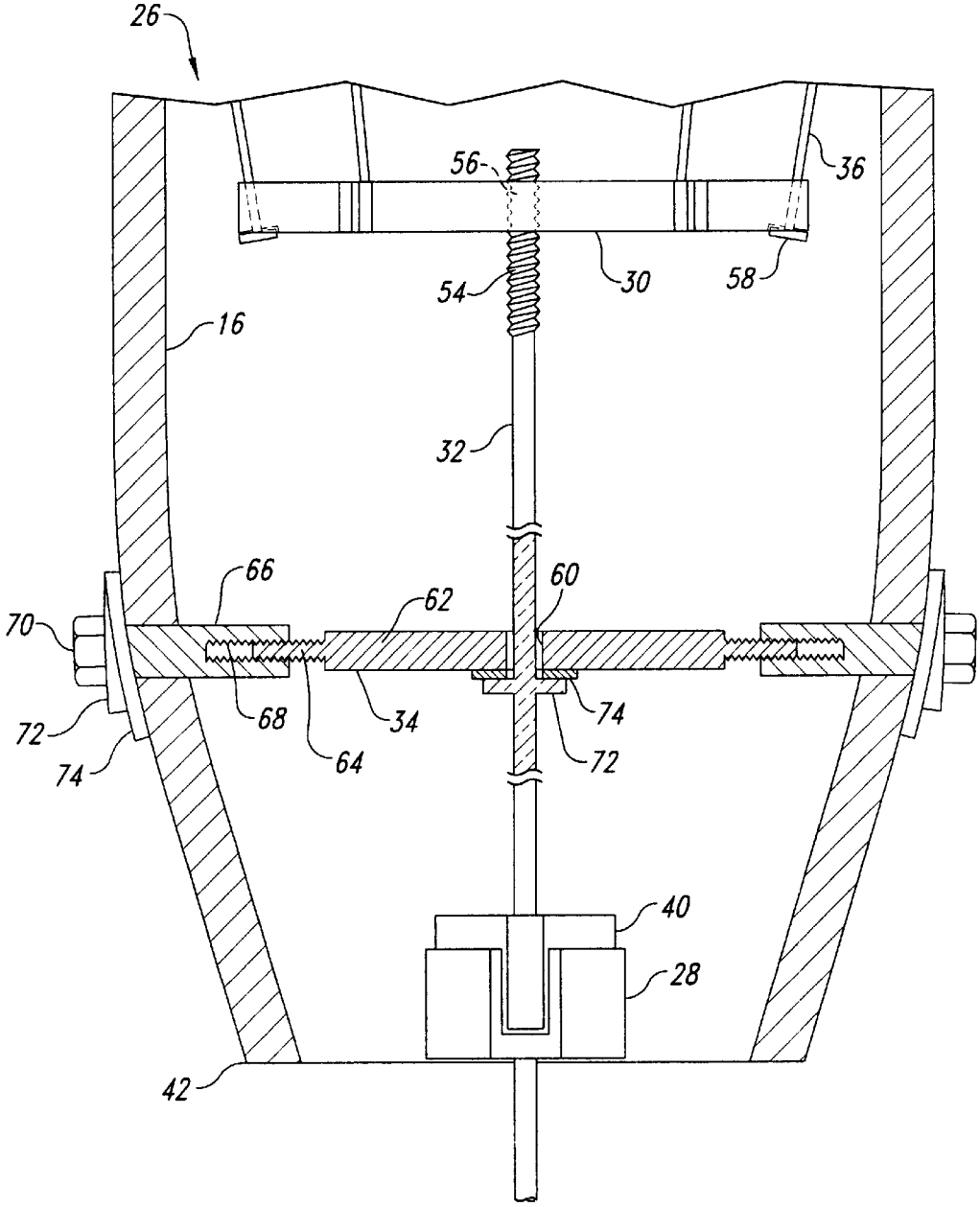
FIG. 4 is an elevation view of a lower portion of the drum of FIG. 2 illustrating the tuning assembly engaged with a portion of the drum stand of FIG. 2, shown with portions of the invention cut along a diametric section.

FIG. 4 illustrates the tuning assembly 26 according to the present embodiment. The spider member 30 is suspended between the cables 36 and the threaded rod 32. A threaded distal end 54 of the threaded rod 32 engages a complementary threaded opening 56 in the spider member 30. Rotation of the spider member 30 with respect to the threaded rod 32 thus results in relative axial movement between the spider member and the threaded rod. As discussed in more detail below, this relative axial movement ultimately results in changing the tension of the drumhead 18. The lower ends of the cables 36 each terminate in an enlarged head 58, that is retained by the spider member 30.

The retaining member 34 of the illustrated embodiment is in the form of a cross with an aperture 60 at the intersection of four legs 62. Each leg 62 terminates at its distal end in a threaded portion 64. An elongated nut 66 having internal threads 68 extends through the shell 16 and threadedly engages the threaded portion 64 of each leg 62. The outer end of the elongated nut 66 terminates in a bolt head 70. In the illustrated embodiment, a washer 72 and a decorative plate 74 are positioned between the bolt head 70 and the shell 16. The retaining member 34 is thus fixedly attached to the shell 16. The inventor appreciates as would one of ordinary skill in the art that many different variations can be made to this particular structure without deviating from the spirit of the invention.

The threaded rod 32 extends from the spider 30 through the retaining member 34, where an enlarged, annular shoulder 72 prevents the threaded rod from moving axially toward the upper end of the drum. A bearing 74 is positioned between the annular shoulder 72 and the retaining member 34 to allow the threaded rod 32 to rotate with respect to the retaining member with reduced friction. Because the threaded rod 32 is prevented by the retaining member 34 from moving axially upward, when the threaded rod is rotated with respect to the spider member 30 the spider member moves downward toward the retaining member.

Figure 10:
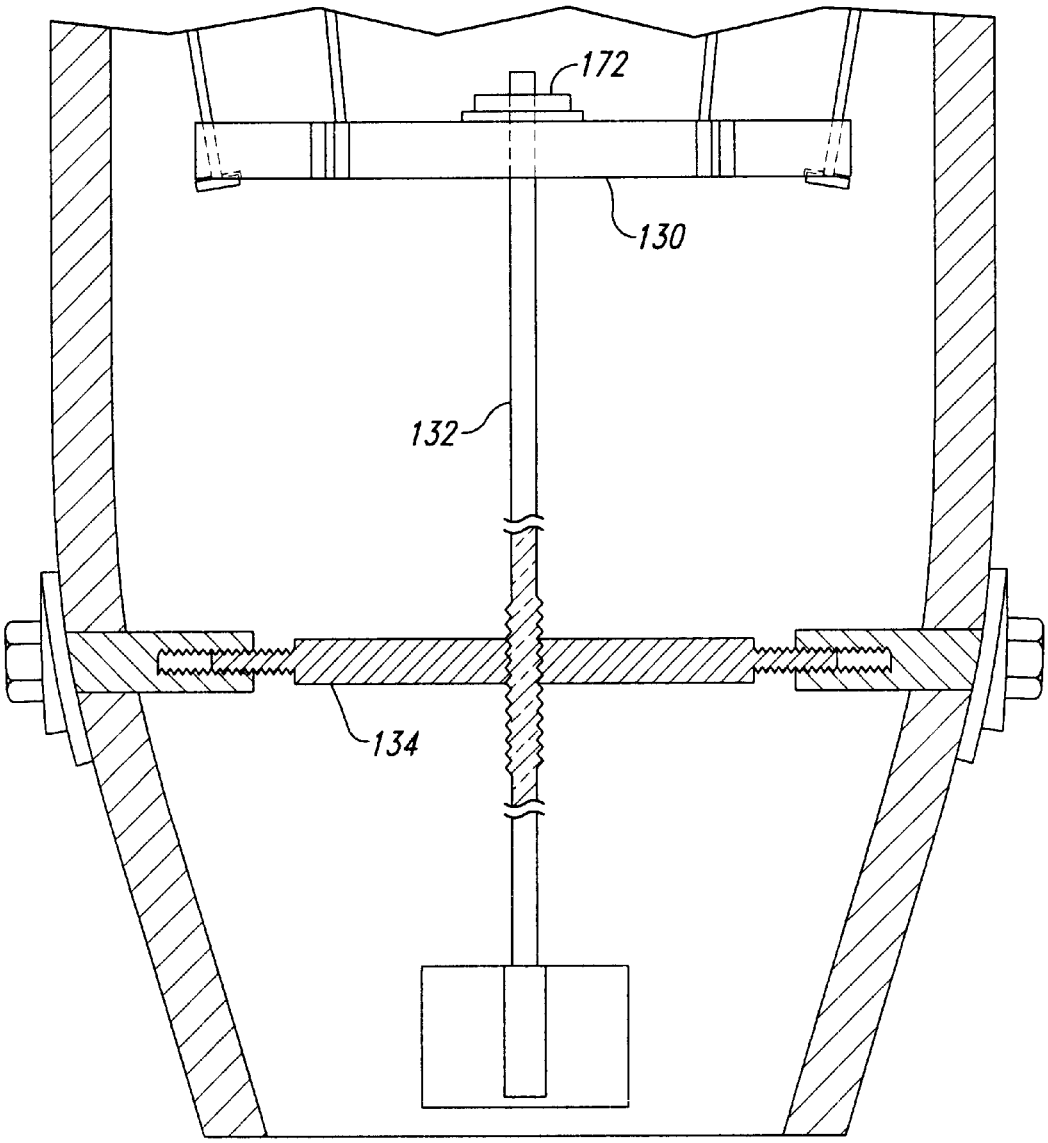
FIG. 10 is an elevation view of a lower portion of a drum and a tuning assembly according to another embodiment of the present invention, shown with portions of the drum cut along a diametric section.

The inventor and one of ordinary skill in the art would appreciate that many various structures can be used to move the spider member 30 axially with respect to the threaded rod 32. For example, as illustrated in FIG. 10, a threaded rod 132 can be threadedly engaged with a retaining member 134 and a shoulder 172 at the extreme distal end of the threaded rod can be seated above a spider member 130 such that rotation of the threaded rod with respect to the retaining member causes the threaded rod, and with it the spider member, to move axially. The inventor appreciates that still further variations can be made without deviating from the spirit of the invention.

Figure 5:
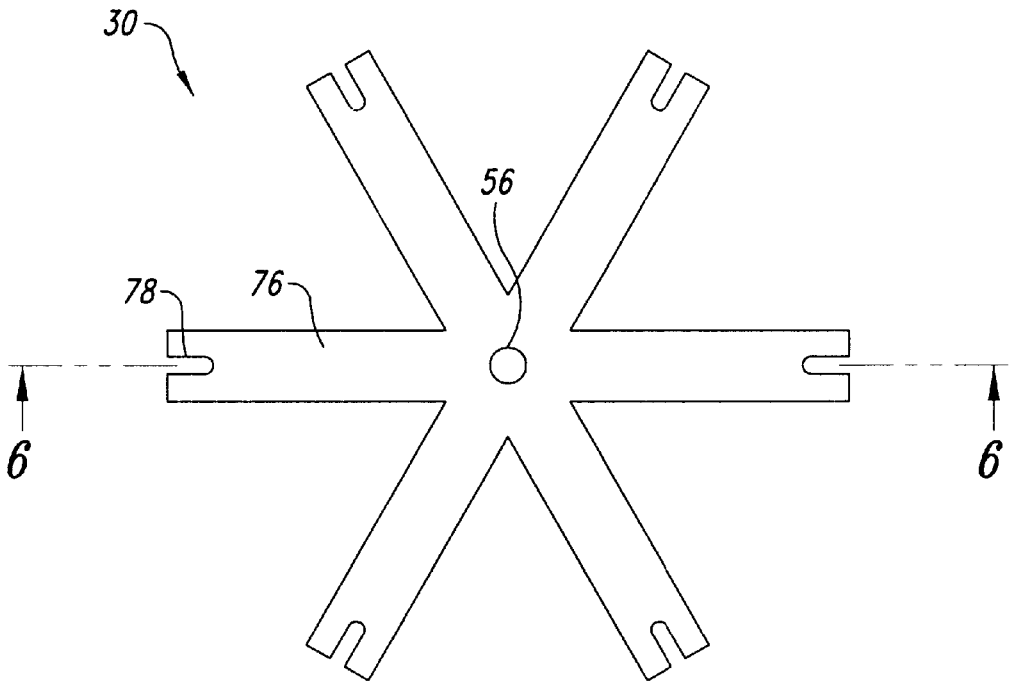
FIG. 5 is a plan view of a spider member of the tuning assembly of FIG. 4.
Figure 6:
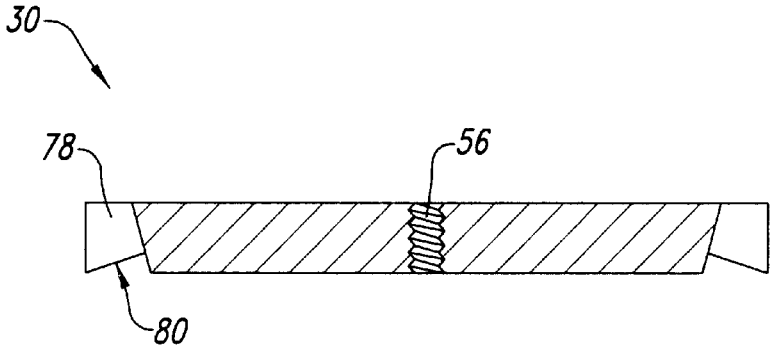
FIG. 6 is a sectional elevation view of the spider member of FIG. 5, seen along Section 6—6.

FIGS. 5 and 6 further illustrate the spider member 30 of the present embodiment. In the illustrated embodiment, six arms 76 project outward, corresponding to the six cables (not shown). For situations where more or fewer cables are used, the spider member 30 would have a different number of arms 76 to correspond with the number of cables in such a situation. The arms 76 are spaced radially at roughly equal angles with respect to the other arms to evenly distribute the forces that the cables 36 exert on the spider member 30. Each arm 76 terminates at its distal end in a groove 78. The groove 78 is sufficiently wide to receive the length of a cable 36 (not shown), but sufficiently narrow to prevent the head 58 (not shown) at the lower end of the cable from passing through the spider member 30. As illustrated in FIG. 6, a bottom surface 80 is tapered to compensate for the angle of the cable 36 as it extends upward from the spider member 30 and outward toward the tuning rim 20 (not shown). The inventor appreciates that other variations or shapes can be used for the spider member 30 without deviating from the spirit of the present invention. For example, a disk-shaped plate with detents distributed about its perimeter could be used. Likewise, the spider member 30 need not be flat, but instead could be curved downward to provide additional strength and/or to obviate the need for the tapered bottom surface 80.

Figure 7:
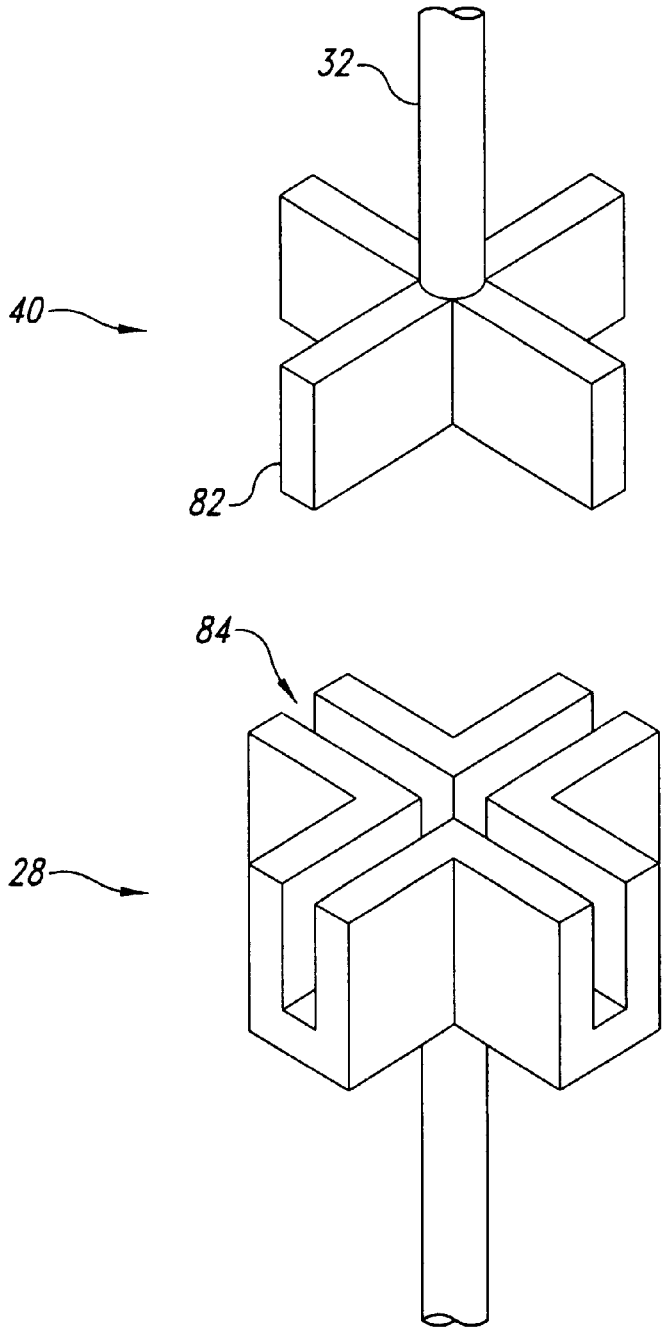
FIG. 7 is an isometric view of a lower portion of the tuning assembly of FIG. 4 and an actuator from the drum stand of FIG. 4.

FIG. 7 better illustrates the key 40, and the actuator 28 of this particular embodiment. The key 40 is fixedly attached to the extreme bottom end of the threaded rod 32. In the illustrated embodiment, the key is in the shape of a Greek cross, although it is appreciated that any number of regular or irregular shapes (other than a circle) can be substituted therefore. The key 40 incorporates four engagement members 82 to faclitate rotating the threaded rod 32. The engagement members 82 are sized to allow an individual to manually rotate the threaded rod 32 in addition to allowing the individual to rotate the threaded rod using the drum stand. Accordingly, configurations for the key 40 that facilitate both manual and assisted rotation would be optimal.

The actuator 28 has a number of channels 84 therein configured to complement the engagement members 82 on the key 40. The channels 84 are open to the top to allow the key 40 to be lowered into the actuator 28 from above when the drum is placed in the stand. The actuator 28 is fixed to the drum stand 14 to prevent relative rotation between the actuator and the stand.

Figure 9:
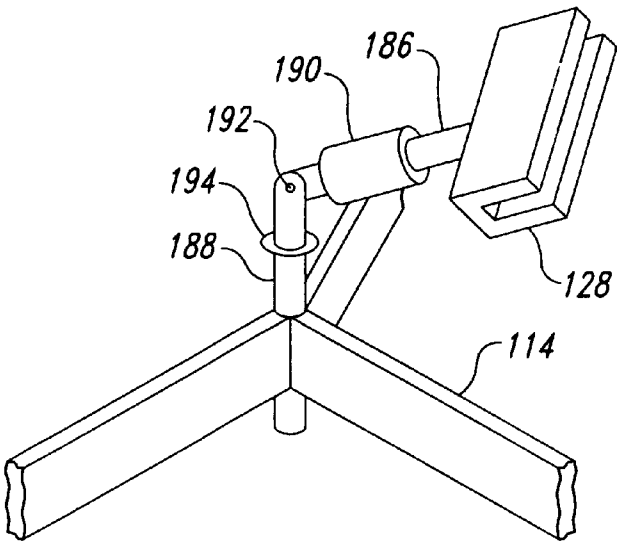
FIG. 9 is an isometric view of the actuator of FIG. 8, shown in an inoperative configuration.
Figure 8:
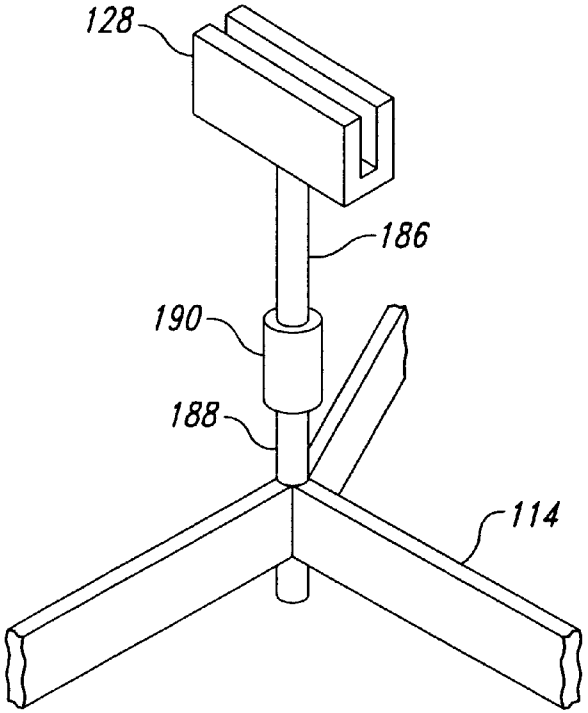
FIG. 8 is an isometric view of an actuator of a drum stand according to another particular embodiment of the present invention, shown in an operative configuration.

FIGS. 8 and 9 illustrate the operative and inoperative configurations, respectively, of another embodiment the actuator of 128. The actuator 128 is connected to the stand 114 by an upper linkage 186 and a lower linkage 188. A locking member 190 is positioned between the upper and lower linkages 186/188 to retain the linkages in axial alignment. In this configuration, i.e., the operating configuration, the actuator 128 is upright and positioned to receive the key (not shown) for tuning the drum.

In FIG. 9, the actuator 128 is in the inoperative configuration. In this configuration, the locking member 190 has moved from the locked position to the unlocked position, allowing the upper linkage 186 to move with respect to the lower linkage 188. In the illustrated embodiment, the upper linkage 186 is pivotally connected at a hinge 192 to the lower linkage 188. The locking member 190 is a sliding collar that, when moved upward, exposes the hinge 192 to allow the actuator 128 to move into the inoperative configuration. When the actuator 128 is moved into the operative configuration, the locking member 190 is able to slide downward over the hinge 192 until it contacts a raised section 194. When the locking member 192 has slid downward until it contacts the raised section 194, the locking member prevents the upper linkage 186 from pivoting with respect to the lower linkage 188, retaining the actuator 128 in the operative configuration. The inventor appreciates that other configurations can be used to perform the above function, and thus various alterations and modifications to this illustrated structure would not deviate from the spirit of the present invention.

Figure 11:
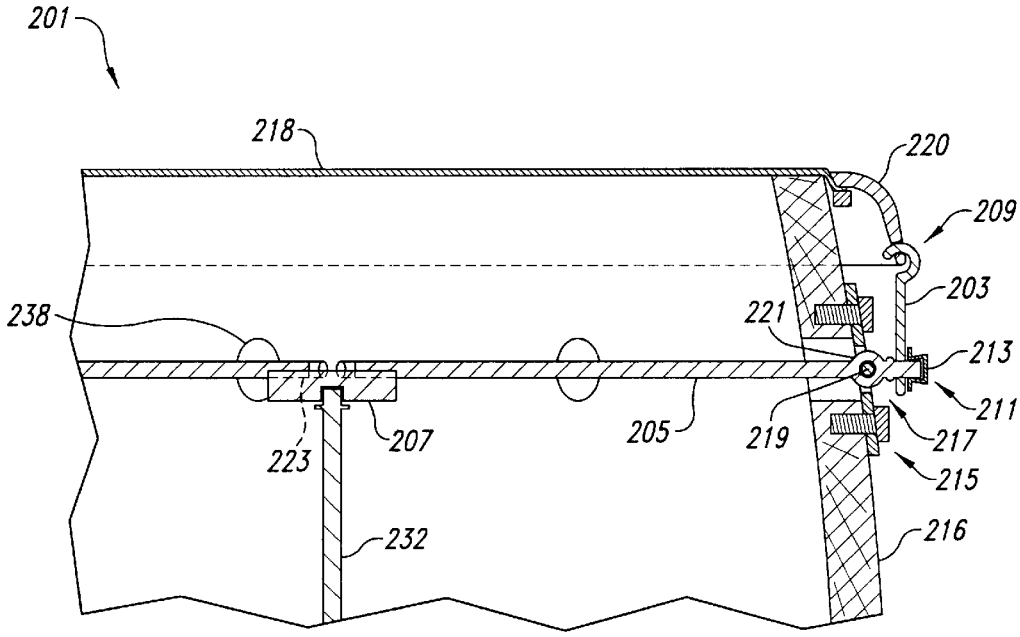
FIG. 11 is a sectional elevation view of an upper portion of a drum according to another embodiment of the present invention.

FIG. 11 illustrates a tuning assembly 201 according to another embodiment of the present invention. In the illustrated embodiment a drumhead 218 is retained against a shell 216 by a tuning ring 220. The tuning assembly of this particular embodiment incorporates a fastener 203, a plurality of linkages 205, a connector member 207, and a threaded rod 232. The parts of the drum and tuning assembly are that are not discussed in detail below are similar or identical to the corresponding parts discussed above. Accordingly, the applicant does not describe these features again.

The fastener 203 is coupled between the tuning ring 220 and the linkage 205. In the illustrated embodiment, an upper end 209 of the fastener 203 is curved and extends through a complementary opening in the tuning ring 220. Similarly, a lower end 211 of the fastener 203 has an opening engaged with the linkage 205. The exact manner of attaching the fastener 203 to the tuning ring 220 and/or to the linkage 205 can vary dramatically without deviating from the spirit of the present invention. A cap or similar structure can be captively engaged with the linkage 205 to prevent the fastener 203 from disengaging from the linkage.

The linkage 205 is pivotally mounted to the shell 216 by a bracket 215. The bracket is mounted to the shell 216 by screws or other suitable fasteners. The bracket 215 has a central opening 217 that aligns with openings 238 in the shell 216. A rod 219 extends generally laterally across the opening 217 in the bracket 215, and serves as a fulcrum about which the linkage 205 can pivot during operation. The rod 219 can be integral with the bracket 215, or can be affixed or otherwise engaged therewith in any suitable manner.

The linkage 205 is contoured to pivot about the rod 219 during operation. In the illustrated embodiment, a ring 221 is formed along the length of the linkage 205, and encircles the rod 219. Because as discussed below the linkage 205 will be urged upward during operation, the upper portion of the ring 221 can be slotted or removed to facilitate engagement of the linkage 205 with the rod 219. The linkage 205 projects a relatively short distance outside of the shell 216, and projects inwardly toward a center line of the shell. Because the length of the portion internal to the drum is significantly greater than the length external to the drum, the force necessary to move the internal end of the linkage 205 is substantially lower than the resultant force generated by the external portion of the linkage.

Each of the linkages 205 engages the connector member 207. In a manner similar to the described above, the connector member moves longitudinally during operation in order to tune the drum. Consequently, the linkages 205 are coupled to the connector member 207 in a manner that allows for relative rotation between the two. In the illustrated embodiment, the linkage 205 rests in a complementary recess 223 that retains the linkage in the proper radial alignment during operation. The inventor appreciates that the linkages can be coupled to the connector member in a wide variety of ways without deviating from the spirit of the present invention.

The threaded rod 232 is engaged to rotate with respect to the connector member 207. In the illustrated embodiment, the threaded rod 232 is seated within an annular depression centrally located in the bottom of the connector member 207. A lower portion of the threaded rod (not shown) can be engaged with a structural member as discussed above to threadly move in a longitudinal direction with respect to the shell 216. When the threaded rod 232 moves longitudinally, the connector member 207 moves as well. The inventor appreciates, however, that the threaded rod 232 can instead by threadly engaged with the connector member 207 such that rotation of the threaded rod results in translation of the connector member. Consequently, the relative movements of the threaded rod 232 and the connector member 207 function similar or identical to those described above.

During operation, the user can rotate the threaded rod 232 to move the threaded rod and the connector member 207 longitudinally within the shell 216. When the connector member 207 moves up or down as oriented in FIG. 11, the external portion of the linkage 205 moves in the opposite direction. As a result, when the connector member 207 moves upward the external portion of the linkage 205 moves downward and the drumhead 218 is tightened. Because the length of the portion of the linkage 205 internal to the drum is substantially greater than the length of the linkage external to the drum, the amount of force required to move the connector member is substantially less than the resulting force exerted by the linkage 205 on the fastener 203 and, in turn, drumhead 218.

Embodiments of the present invention have numerous advantages over devices of the prior art. For example, because the key is manipulable both by hand and with the drum stand, the invention allows an individual to conveniently tune the invention both with and without the drum stand, and allows an individual to easily remove the drum from the drum stand to prevent accidental changes to the tension of the drumhead. To further prevent accidental changes, the cables extending from the tuning ring to the tuning assembly of the present invention extend almost entirely inside the drum shell. Thus, the drummer's hands, knees or the drum stand will not accidentally contact the cables, putting them in further tension and accidentally altering the tone of the drum.

Still further, because the actuator of the present invention is movable between operative and inoperative configurations, the drum can be left in the drum stand between uses and during use without the risk of accidentally changing the tension in the drumhead. Instead, the user merely moves the actuator into the inoperative position and uses the drum without worry that the tension of the drumhead will accidentally be changed.

Still further, because the tuning assembly is retained entirely within the boundaries of the shell, the drum can be set on the ground or otherwise carried and utilized without structural members getting in the way.

Figure 12:
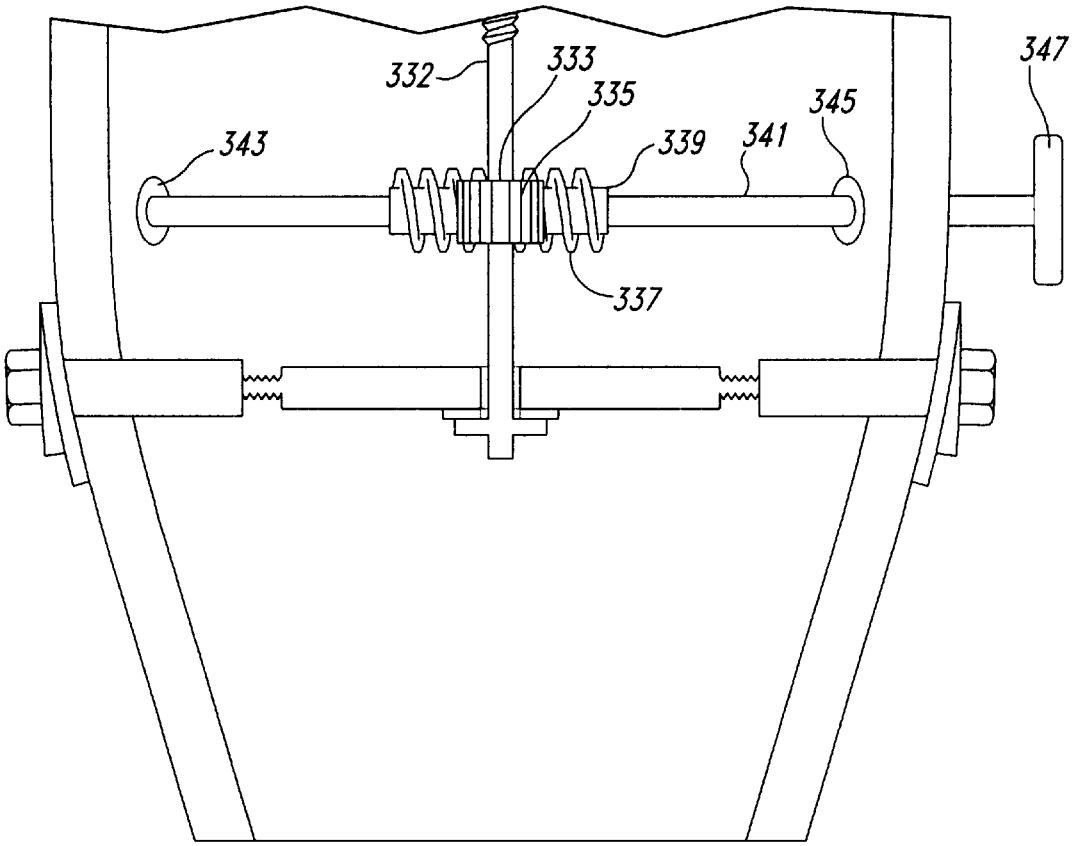
FIG. 12 is a sectional elevation view of a lower portion of a drum according to another embodiment of the present invention.

FIG. 12 illustrates another embodiment of the present invention. In the illustrated embodiment, threaded rod 332 is engaged to rotate with respect to the drum, as discussed above. The threaded rod 332 has a worm gear 333 fixed to it to rotate with the threaded rod during operation. The worm gear 333 has teeth 335 spaced around it, as is generally understood in the art. The teeth 335 on the worm gear 333 are enmeshed with a complementary thread 337 on a screw member 339.

The screw member 339 is oriented perpendicular to the worm gear 333, such that rotation of the screw member 339 results in rotation of the worm gear 333. The screw member 339 is fixed to a shaft 341 that extends across the internal cavity of the drum. One end of the shaft 341 is rotatably coupled to a bushing 343 in the shell of the drum, and the other end of the shaft extends through a similar bushing 345 on an opposing side of the shell. The shaft 341 projects beyond the shell, outside of the drum, and terminates in a handle 347.

During operation, the user can manually rotate the handle 347 to tune the drumhead. When rotated, the handle 347 causes the shaft 341 to rotate. When the shaft 341 rotates, the screw member 339 also rotates which, as discussed above, causes the worm gear 333 to rotate. When the worm gear 333 rotates, the threaded rod 332 rotates with it. As discussed above, when the threaded rot 332 rotates, the tension in the drumhead changes. Thus, when the handle 347 is turned, the drum is tuned.

The inventor appreciates that the illustrated configuration is indeed merely illustrative. One of ordinary skill in the art, after reviewing the present disclosure, will appreciate that there are many equivalent means of transferring rotational movement from a first shaft to a second, unaligned shaft. In addition, the gear ratio between the two shafts can be adjusted to increase or decrease the torque transfer from the first shaft to the second shaft.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A drum assembly for use in combination with a drumhead and a tuning ring, the tuning ring being adapted to change the tension in the drumhead when the tuning ring moves axially with respect to the drum assembly, the drum assembly comprising:

a shell with a mouth at one end thereof, the mouth being adapted to mate with the drumhead and the tuning ring; and a tuning assembly, comprising:

a plurality of linkages having first and second portions spaced apart from each other, the first portion of each linkage being adapted to be coupled to the tuning ring during use;

a connector member positioned within the shell and being axially movable with respect to the shell, the second portion of each linkage being in operable contact with the coupling member; and a compound adjustment member having first and second portions, the first portion of the compound adjustment member being oriented at least substantially axially with respect to the shell and being threadedly coupled between the shell and the connector member such that rotation of the first portion of the compound adjustment member with respect to the shell results in axial movement of the connector member with respect to the shell, the second portion of the compound adjustment member being oriented at an angle with respect to the first portion of the compound adjustment member and being coupled to the first portion of the adjustment member such that rotation of the second portion of the compound adjustment member results in rotation of the first portion of the compound adjustment member; whereby rotation of the second portion of the adjustment member when the drumhead and tuning ring are engaged with the drum assembly adjusts the tension of the drumhead.

2. The drum assembly of claim 1 wherein the shell has a mouth at each end.

3. The drum assembly of claim 1 wherein the shell has a second mouth at the end of the shell opposite the first end, and further comprising a second tuning assembly configured to adjust the tension of a drumhead engaged with the second mouth.

4. The drum assembly of claim 1 wherein the second portion of each linkage is coupled directly to the tuning ring.

5. The drum assembly of claim 1 further comprising at least one intermediate member coupled between the tuning ring and the second portion of each linkage.

6. The drum assembly of claim 1 further comprising at least one adjustable member coupled between the tuning ring and the second portion of each linkage such that the engagement between the tuning assembly and the tuning ring can be adjusted.

7. The drum assembly of claim 1 wherein each linkage comprises a length of cable.

8. The drum assembly of claim 1 wherein the first portion of each linkage is positioned within a groove in a surface of the connector member.

9. The drum assembly of claim 1 wherein the first portion of the compound adjustment member is threadedly coupled to the connector member such that relative rotation therebetween results in axial movement of the connector member with respect to the first portion of the compound adjustment member.

10. The drum assembly of claim 1 wherein the first portion of the compound adjustment member is threadedly coupled to the shell such that relative rotation therebetween results in axial movement of both the first portion of the compound adjustment member and the connector member with respect to the shell.

11. The drum assembly of claim 1 wherein the second portion of the compound adjustment member is at least substantially perpendicular to the first portion of the compound adjustment member.

12. The drum assembly of claim 1 wherein the second portion of the compound adjustment member has a handle at its terminal end.

13. The drum assembly of claim 1 wherein the second portion of the compound adjustment member has a handle at its terminal end, the handle being positioned outside the shell.

14. The drum assembly of claim 1 wherein the first and second portions of the compound adjustment member are engaged at a worm gear.

15. A drum comprising:

a shell with a mouth at one end thereof;

a drumhead positioned over the mouth;

a tuning ring urging a perimeter of the drumhead over the end of the shell; and a tuning assembly, comprising:

a plurality of linkages having first and second portions spaced apart from each other, the first portion of each linkage being coupled to the tuning ring;

a connector member positioned within the shell and being axially movable with respect to the shell, the second portion of each linkage being in operable contact with the coupling member; and a compound adjustment member having first and second portions, the first portion of the compound adjustment member being oriented at least substantially axially with respect to the shell and being threadedly coupled between the shell and the connector member such that rotation of the first portion of the compound adjustment member with respect to the shell results in axial movement of the connector member with respect to the shell, the second portion of the compound adjustment member being oriented at an angle with respect to the first portion of the compound adjustment member and being coupled to the first portion of the compound adjustment member such that rotation of the second portion of the compound adjustment member results in rotation of the first portion of the compound adjustment member; whereby rotation of the second portion of the compound adjustment member when the drumhead and tuning ring are engaged with the drum assembly adjusts the tension of the drumhead.

16. A drum according to claim 15 wherein the second portion of the compound adjustment member is at least substantially perpendicular to the first portion of the compound adjustment member.

17. The drum assembly of claim 15 wherein the second portion of the compound adjustment member has a handle at its terminal end.

18. The drum assembly of claim 15 wherein the second portion of the compound adjustment member has a handle at its terminal end, the handle being positioned outside the shell.

19. The drum assembly of claim 15 wherein the first and second portions of the compound adjustment member are engaged at a worm gear.

20. A tuning assembly for a drum wherein the drum incorporates a shell, a drumhead and a tuning ring, the tuning assembly comprising:

a plurality of linkages having first and second portions spaced apart from each other, the first portion of each linkage being adapted to be coupled to the tuning ring during use;

a connector member adapted to be positioned within the shell and to be axially movable with respect to the shell, the second portion of each linkage being in operable contact with the coupling member; and a compound adjustment member having first and second portions, the first portion of the compound adjustment member being adapted to be oriented at least substantially axially with respect to the shell and to be threadedly coupled between the shell and the connector member such that rotation of the first portion of the compound adjustment member with respect to the shell would result in axial movement of the connector member with respect to the shell, the second portion of the compound adjustment member being oriented at an angle with respect to the first portion of the compound adjustment member and being coupled to the first portion of the adjustment member such that rotation of the second portion of the compound adjustment member results in rotation of the first portion of the compound adjustment member.

21. The tuning assembly of claim 20 wherein the first portion of the compound adjustment member is threadedly coupled to the connector member such that relative rotation therebetween results in axial movement of the connector member with respect to the first portion of the compound adjustment member.

22. The tuning assembly of claim 20 wherein the first portion of the compound adjustment member is adapted to be threadedly coupled to the shell such that relative rotation therebetween results in axial movement of both the first portion of the compound adjustment member and the connector member with respect to the shell.

23. The tuning assembly of claim 20 wherein the second portion of the compound adjustment member is at least substantially perpendicular to the first portion of the compound adjustment member.

24. A method for facilitating the tuning of a drum, the method comprising:

extending a plurality of linkages from a tuning ring at an end of the drum to a connector member positioned inside the drum such that axial movement of the connector member results in axial movement of the tuning ring; and coupling the connector member to a handle at the side of the drum such that rotation of the handle results in axial movement of the connector member.

25. The method of claim 24 wherein coupling the connector member to a handle at the side of the drum comprises coupling the connector to a handle located external to the drum.

* * * * *